US006382192B2

(12) United States Patent
Kitajima et al.

(10) Patent No.: US 6,382,192 B2
(45) Date of Patent: May 7, 2002

(54) EVAPORATING FUEL PROCESSING APPARATUS AND METHOD OF INTERNAL COMBUSTION ENGINE

(75) Inventors: Shinichi Kitajima; Hideyuki Oki; Atsushi Matsubara, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/736,123

(22) Filed: Dec. 15, 2000

(30) Foreign Application Priority Data

Dec. 20, 1999 (JP) ..... 11-361922

(51) Int. Cl.[7] ..... F02M 37/04
(52) U.S. Cl. ..... 123/520
(58) Field of Search ..... 123/516, 518, 123/519, 520

(56) References Cited

U.S. PATENT DOCUMENTS 5,351,193 A * 9/1994 Poirier et al. ..... 123/520
6,227,037 B1 * 5/2001 Kawamura et al. ..... 123/520

FOREIGN PATENT DOCUMENTS

JP A-07-012016 1/1995
JP A-09-317572 12/1997

* cited by examiner

*Primary Examiner*—Thomas N. Moulis
(74) *Attorney, Agent, or Firm*—Arent Fox Kintner Plotkin & Kahn, PLLC

(57) ABSTRACT

An evaporating fuel processing apparatus of an internal combustion engine is disclosed, which can reliably determine the presence or absence of leakage even if stopping and restarting operations of the internal combustion engine are alternately repeated. The apparatus comprises a leakage detecting section for detecting leakage in the evaporating fuel processing apparatus by referring to parameters; a stop condition determining section for determining whether a predetermined condition for stopping the internal combustion engine is satisfied; a stop section for stopping the internal combustion engine when the stop condition determining section determines that the predetermined condition is satisfied; a restart section for restarting the internal combustion engine after the internal combustion engine is stopped by the stop section; a storage section for storing parameters referred to by the leakage detecting section; and an initializing section for initializing the parameters when an ignition switch for starting the internal combustion engine is switched on.

12 Claims, 8 Drawing Sheets

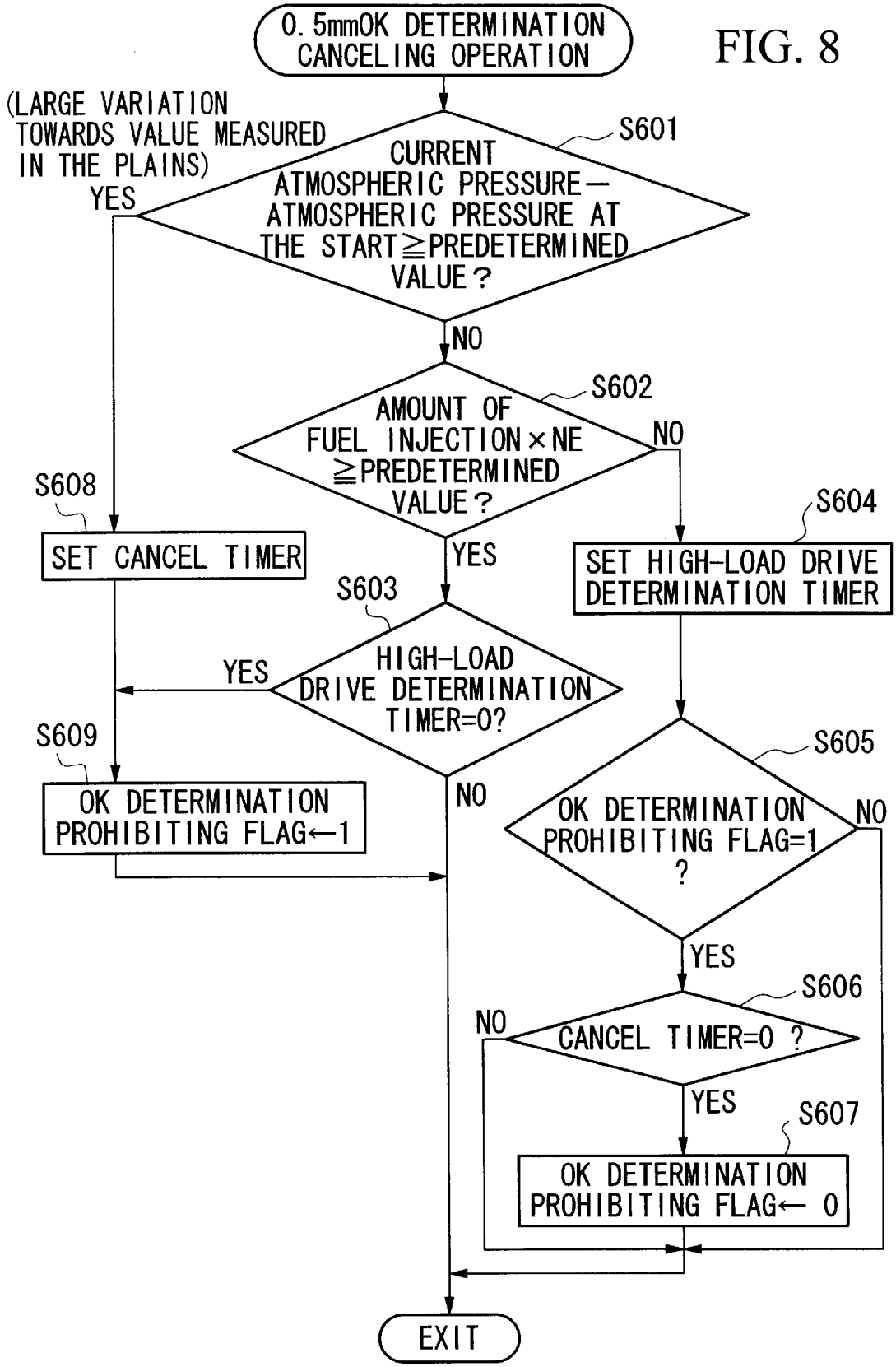
0.5mmOK DETERMINATION CANCELING OPERATION
FIG. 8
(LARGE VARIATION TOWARDS VALUE MEASURED IN THE PLAINS)
YES
S601
CURRENT ATMOSPHERIC PRESSURE − ATMOSPHERIC PRESSURE AT THE START ≧ PREDETERMINED VALUE ?
NO
S602
AMOUNT OF FUEL INJECTION × NE ≧ PREDETERMINED VALUE ?
NO
S608
SET CANCEL TIMER
S604
SET HIGH-LOAD DRIVE DETERMINATION TIMER
YES
S603
HIGH-LOAD DRIVE DETERMINATION TIMER=0?
YES
S609
OK DETERMINATION PROHIBITING FLAG←1
NO
S605
OK DETERMINATION PROHIBITING FLAG=1 ?
NO
YES
S606
NO
CANCEL TIMER=0 ?
YES
S607
OK DETERMINATION PROHIBITING FLAG← 0
EXIT

EVAPORATING FUEL PROCESSING APPARATUS AND METHOD OF INTERNAL COMBUSTION ENGINE

BACKGROUND OF THE INVENTION

1. Field of the Invention

The present invention relates to an evaporating fuel processing apparatus and method for processing evaporating fuel generated in a fuel tank and discharging it towards an air intake system of the internal combustion engine, and in particular, to an apparatus having a function of determining presence or absence of leakage of evaporating fuel in an evaporating-fuel-discharge suppression system which is provided between the fuel tank and the air intake system.

2. Description of the Related Art

A typical conventional apparatus for processing evaporating fuel comprises a fuel tank, a canister for absorbing evaporating fuel generated in the fuel tank, a charge passage for joining the canister and the fuel tank, a purge passage for connecting the canister and an engine air intake system, and the like. Japanese Unexamined Patent Application, First Publication, No. Hei 7-12016 discloses a method of determining presence or absence of leakage of such an evaporating fuel processing apparatus.

In the disclosed method, in the general operation mode of the engine, if a detected internal pressure in the tank is negative with respect to the atmospheric pressure by a predetermined value or more, then it is determined that no leakage of evaporating fuel has occurred from the evaporating fuel processing apparatus and the purge operation is being executed under normal conditions. If it is not determined that the present state is normal, for example, when the internal pressure of the fuel tank stays at approximately the atmospheric pressure for a predetermined time, then it is determined that leakage may be occurring, and a leakage diagnosis process is executed. In this process, a discharge suppression system including the evaporating fuel processing apparatus is made to have a negative-pressure state, and the presence or absence of leakage is determined with reference to the ability of maintaining the negative pressure.

On the other hand, Japanese Unexamined Patent Application, First Publication, No. Hei 9-317572 discloses an evaporating fuel processing apparatus having a bypass valve for bypassing a pressure regulating valve provided in a charge passage for joining a fuel tank and a canister, and the evaporating fuel processing apparatus determines presence or absence of leakage in both of (i) the fuel tank side from the bypass valve to the fuel tank, and (ii) the canister side from the bypass valve to the canister.

In the determination of the presence or absence of leakage in the fuel tank side, the bypass valve is opened immediately after the internal combustion engine is started, so as to increase the pressure in the fuel tank towards the atmospheric pressure, and if the variation of the pressure in the fuel tank is larger than a predetermined value, then it is determined that no leakage of the fuel tank is found and the operation thereof is normal. That is, if leakage occurs in the fuel tank, the pressure in the fuel tank before the start of the internal combustion engine is approximately equal to the atmospheric pressure, and thus the variation of the pressure in the fuel tank is small.

In the above-explained conventional evaporating fuel processing apparatuses, when the internal combustion engine is started, various initial processes are performed, for example, (i) the pressure value in the fuel tank at the starting time is stored, (ii) the timer value of a subtraction timer, referred to in the process of determining the presence or absence of leakage, is set to a predetermined initial value, and (iii) various parameters such as the elapsed time from the starting time of the internal combustion engine and the total value of the fuel consumption are initialized.

If a vehicle is driven in an idle driving state, an "idle stop" operation may be executed, in which the internal combustion engine is stopped and any unnecessary idle driving operation is prohibited so as to reduce fuel consumption. If the idle stop and restart of the internal combustion engine are alternately performed, then the parameters referred to in the process of determining the presence or absence of leakage are initialized every time the internal combustion engine is restarted. However, some parameters need their initial values provided when the internal combustion engine is first started (that is, when the internal combustion engine is cold). Therefore, the presence or absence of leakage may not be determined correctly.

SUMMARY OF THE INVENTION

In consideration of the above circumstances, an objective of the present invention is to provide an evaporating fuel processing apparatus and method of an internal combustion engine, which can reliably determine the presence or absence of leakage even if stopping and restarting operations of the internal combustion engine are alternately repeated after the internal combustion engine is initially started.

Therefore, the present invention provides an evaporating fuel processing apparatus of an internal combustion engine, comprising:

a fuel tank;

an evaporating fuel discharge suppression system for processing evaporating fuel generated in the fuel tank;

a leakage detecting section for detecting leakage in the evaporating fuel processing apparatus by referring to one or more parameters;

a stop condition determining section for determining whether a predetermined condition for stopping the internal combustion engine is satisfied;

a stop section for stopping the internal combustion engine when the stop condition determining section determines that the predetermined condition is satisfied;

a restart section for restarting the internal combustion engine after the internal combustion engine is stopped by the stop section;

a storage section for storing the one or more parameters referred to by the leakage detecting section; and an initializing section for initializing the one or more parameters when an ignition switch for starting the internal combustion engine is switched on.

The processes of steps S210 to S223, S306 to S311, and S404 to S421 explained later disclose an example of the detection performed by the leakage detecting section. The leakage detecting section, stop condition determining section, stop section, restart section, storage section, and initializing section can be realized by using, for example, an ECU 13 explained below. The processes of steps S206 to S208, S303, and S403 explained below disclose an example of the initialization process executed by the initializing section.

According to the above structure, the initializing section initializes the one or more parameters only when an ignition switch for starting the internal combustion engine is switched on. Therefore, after the internal combustion engine is initially started, even if the operations of (temporarily) stopping and restarting the internal combustion engine are repeated due to the idle stop or the like, it is possible to prevent the above parameters from being initialized for each restart. Accordingly, the presence or absence of leakage of the evaporating fuel processing apparatus of the internal combustion engine can be reliably performed.

The evaporating fuel processing apparatus may further comprise a pressure detecting section for detecting the internal pressure of the fuel tank as a parameter referred to by the leakage detecting section and stored by the storage section.

On the other hand, the evaporating fuel processing apparatus may further comprise a timer for measuring the elapsed time from the starting time of the internal combustion engine as a parameter referred to by the leakage detecting section and stored by the storage section.

Typically, the evaporating fuel processing apparatus is mounted in a vehicle, and the predetermined condition may be that the speed of the vehicle is below a predetermined value, and the shift position of the vehicle is in a neutral or parking position.

The present invention also provides an evaporating fuel processing method of an internal combustion engine, applied to an evaporating fuel processing apparatus comprising a fuel tank, and an evaporating fuel discharge suppression system for processing evaporating fuel generated in the fuel tank, the method comprising:

a leakage detecting step for detecting leakage in the evaporating fuel processing apparatus by referring to one or more parameters;

a stop condition determining step for determining whether a predetermined condition for stopping the internal combustion engine is satisfied;

an engine stopping step for stopping the internal combustion engine when it is determined in the stop condition determining step that the predetermined condition is satisfied;

a restarting step for restarting the internal combustion engine after the internal combustion engine is stopped in the engine stopping step;

a storage step for storing the one or more parameters referred to by the leakage detecting step in a storage device; and an initializing step for initializing the one or more parameters stored in the storage device when an ignition switch for starting the internal combustion engine is switched on.

The present invention also provides a computer readable storage medium storing a program for making a computer execute an evaporating fuel processing operation of an internal combustion engine, applied to an evaporating fuel processing apparatus which comprises a fuel tank, and an evaporating fuel discharge suppression system for processing evaporating fuel generated in the fuel tank, the operation comprising:

a leakage detecting step for detecting leakage in the evaporating fuel processing apparatus by referring to one or more parameters;

a stop condition determining step for determining whether a predetermined condition for stopping the internal combustion engine is satisfied;

an engine stopping step for stopping the internal combustion engine when it is determined in the stop condition determining step that the predetermined condition is satisfied;

a restarting step for restarting the internal combustion engine after the internal combustion engine is stopped in the engine stopping step;

a storage step for storing the one or more parameters referred to by the leakage detecting step in a storage device; and an initializing step for initializing the one or more parameters stored in the storage device when an ignition switch for starting the internal combustion engine is switched on.

BRIEF DESCRIPTION OF THE DRAWINGS

FIG. 8 is a flowchart showing the canceling operation shown in FIG. 6 in the embodiment.

DESCRIPTION OF THE PREFERRED EMBODIMENTS

Hereinafter, an embodiment of the evaporating fuel processing apparatus of an internal combustion engine according to the present invention will be explained with reference to the drawings.

Figure 1:
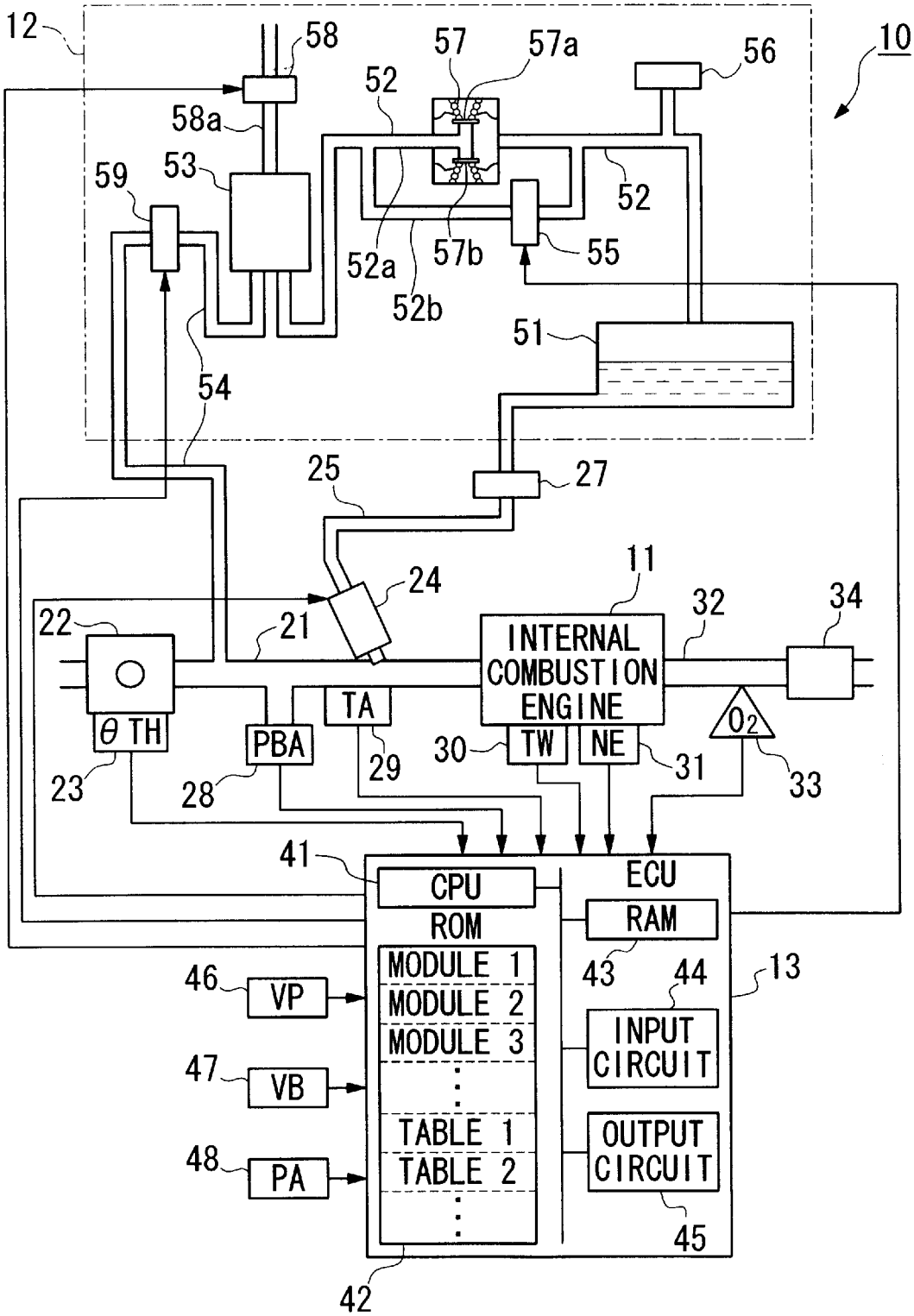
FIG. 1 is a diagram showing the structure of the evaporating fuel processing apparatus of an internal combustion engine as an embodiment according to the present invention.

FIG. 1 is a diagram showing the structure of an evaporating fuel processing apparatus 10 of internal combustion engine 11 in the embodiment. The evaporating fuel processing apparatus 10 of the present embodiment comprises an evaporating fuel discharge suppression system 12, and ECU (electric control unit) 13.

The internal combustion engine 11 is, for example, a multiple cylinder engine including four cylinders. A throttle valve 22 is provided in the middle of an air intake pipe 21 which joins with the internal combustion engine 11. In addition, a sensor 23 for detecting the degree of throttle opening (θTH) is provided at the throttle valve 22, and the sensor 23 outputs and supplies an electric signal corresponding to the degree of throttle opening (of throttle 22) to ECU 13.

A fuel injection valve 24 for each cylinder is provided in the middle of the air intake pipe 21, and at the upstream side of an air intake valve (not shown) provided between the internal combustion engine 11 and the throttle valve 22. In addition, the fuel injection valve 24 is connected to the fuel tank 51 via a fuel supply pipe 25, and a fuel pump 27 is provided in the middle of the fuel supply pipe 25.

The fuel injection valve 24 is electrically connected to ECU 13, and the time (i.e., fuel injection time) during which the fuel injection valve 24 is open is controlled by an electric signal from the ECU 13.

In addition, a regulator (not shown) is provided, between the fuel injection valve 24 and fuel pump 27, for maintaining a fixed differential pressure between the pressure of air supplied from the air intake pipe 21 and the pressure of the fuel supplied via the fuel supply pipe 25. If the pressure of the fuel is too high, excessive fuel is returned to the fuel tank 51 via a return pipe (not shown). The air introduced via the throttle valve 22 is mixed with the fuel injected from the fuel injection valve 24 via the air intake pipe 21, and the mixed material is supplied to each cylinder of the internal combustion engine 11.

At the downstream side (that is, the internal combustion engine 11 side) of the throttle valve 22 in the air intake pipe 21, a sensor 28 for detecting the absolute pressure (PBA) in the air intake pipe is provided. The absolute pressure in the air intake pipe 21 is converted to an electric signal and is supplied to ECU 13 by the sensor 28. In addition, a sensor 29 for detecting the temperature of the intake air (TA) is provided at the downstream side of the sensor 28 for detecting PBA. Accordingly, an electric signal indicating a measured temperature value of the intake air is supplied to ECU 13.

A water temperature (TW) sensor 30 provided at the internal combustion engine 11 includes, for example, a thermister, and sensor 30 measures the temperature of the cooling water of the internal combustion engine 11 and outputs a corresponding electric signal to ECU 13. A rotational speed (NE) sensor 31 is provided in the vicinity of a cam (not shown) or a crankshaft (not shown) of internal combustion engine 11. Each cylinder of the internal combustion engine 11 is periodically at a TDC (top dead center) after the air intake process is started, and if the engine is a four-cylinder type, the NE sensor 31 outputs a TDC pulse signal, for example, for each crank angle of 180 degrees with respect to the TDC. Each pulse signal is supplied to ECU 13.

The exhaust pipe 32 is connected to each cylinder of the internal combustion engine 11, so that a set of exhaust pipes is formed (not shown). An $O_2$ sensor 33 is provided in the exhaust pipe 32, and the $O_2$ sensor 33 is, for example, a proportional air-fuel ratio (LAF) sensor functioning as a proportional oxygen content detector, and the sensor 33 outputs and supplies an electric signal approximately in proportion to the concentration of the oxygen in the exhaust gas to ECU 13.

At the downstream side of the $O_2$ sensor 33, a catalyst for purifying some components such as HC, CO, and $NO_x$ in the exhaust gas is provided. An example thereof is a three way catalyst (TWC) 34.

The ECU 13 comprises CPU 41 for executing operations for controlling the internal combustion engine 11, ROM 42 for storing various operation programs and operation data, RAM 43 for temporarily storing data input from the internal combustion engine 11 and commands to be sent to the internal combustion engine 11, and input circuit 44 for receiving data input from the internal combustion engine 11, and output circuit 45 for sending control commands to internal combustion engine 11.

Some sensors are connected to the ECU 13, such as (i) vehicle speed sensor 46 for detecting speed VP of the vehicle in which the internal combustion engine 11 is mounted, battery voltage sensor 47 for detecting battery voltage VB, and atmospheric pressure sensor 48 for detecting the atmospheric pressure PA, and detected signals of these sensors are supplied to ECU 13.

The input signal from each sensor is provided to input circuit 44, and the input circuit 44 shapes the waveform of the input signal and corrects the voltage level of the signal to a predetermined level, so as to convert the analog signal value to a digital signal value. The CPU 41 processes the converted digital signal, and executes an operation according to an operation program stored in ROM 42. The CPU 41 generates and outputs, for example, a control signal sent to each actuator (not shown) of the vehicle via output circuit 45.

The evaporating fuel discharge suppression system (abbreviated to "discharge suppression system", hereinbelow) 12 comprises fuel tank 51, charge passage 52, canister 53, and purge passage 54, and controls the discharge of the evaporating fuel from the fuel tank 51. For convenience of the following explanations, the discharge suppression system 12 is divided into two systems at the bypass valve 55 (provided in the charge passage 52) as a boundary, where the side including the fuel tank 51 is called a "tank system", while the side including the canister 53 is called a "canister system".

The fuel tank 51 is connected to canister 53 via charge passage 52, and the charge passage 52 comprises first branch passage 52*a* and second branch passage 52*b*. In the charge passage 52 positioned between the fuel tank 51 and both the branch passages 52*a* and 52*b*, internal pressure sensor 56 for detecting the differential pressure between the pressure in the charge passage 52 and the atmospheric pressure is provided.

In the steady state, the pressure in the charge passage 52 is approximately equal to the pressure in the fuel tank 51; thus, the pressure detected by the internal sensor 56 can be regarded as the pressure in the fuel tank 51 (called "tank internal pressure", hereinbelow).

In the first branch passage 52*a*, a two-way valve 57 for adjusting the tank internal pressure is provided, which has two mechanical valves, that is, positive pressure valve 57*a* and negative pressure valve 57*b*.

The positive pressure valve 57*a* is opened when the tank internal pressure becomes larger than the atmospheric pressure, for example, by approximately 2 kPa, and in this open state, evaporating fuel is absorbed by activated carbon in canister 53.

The negative pressure valve 57*b* is opened when the tank internal pressure becomes larger than the pressure at the canister side, for example, by approximately 1.3 to 2 kPa, and in this open state, the evaporating fuel absorbed into canister 53 is returned to the fuel tank 51.

In addition, a bypass valve 55 is provided in the second branch passage 52*b*. The bypass valve 55 is usually closed, and as explained later, the opening/closing operation thereof is controlled by using a control signal from ECU 13 when the presence or absence of leakage in the discharge suppression system 12 is detected.

The canister 53 includes activated carbon for absorbing fuel vapor, and has an inlet (not shown) communicating with the atmosphere via passage 58*a*. In the middle of the passage 58*a*, for example, vent-shut valve 58 functioning as an electromagnetic valve is provided. The vent-shut valve 58 is usually opened, and as explained later, the opening/closing operation thereof is controlled by using a control signal from ECU 13 when the presence or absence of leakage in the discharge suppression system 12 is detected.

The canister 53 is connected via purge passage 54 to the downstream side (i.e., the internal combustion engine 11 side) of the throttle valve 21, and in the middle of the purge passage 54, a purge control valve 59 functioning as an electromagnetic valve is provided. The evaporating fuel absorbed into canister 53 is purged via the purge control valve 59 into the air intake system of the internal combustion engine 11.

The on-off duty ratio of the purge control valve 59 can be changed based on the control signal from ECU 13, thereby continuously controlling the discharge or flow rate in the purge operation.

The evaporating fuel processing apparatus 10 in the present embodiment has the above-explained structure. Below, the operation of the evaporating fuel processing apparatus 10 will be explained with reference to the drawings.

Tank monitoring operation

Figure 2:
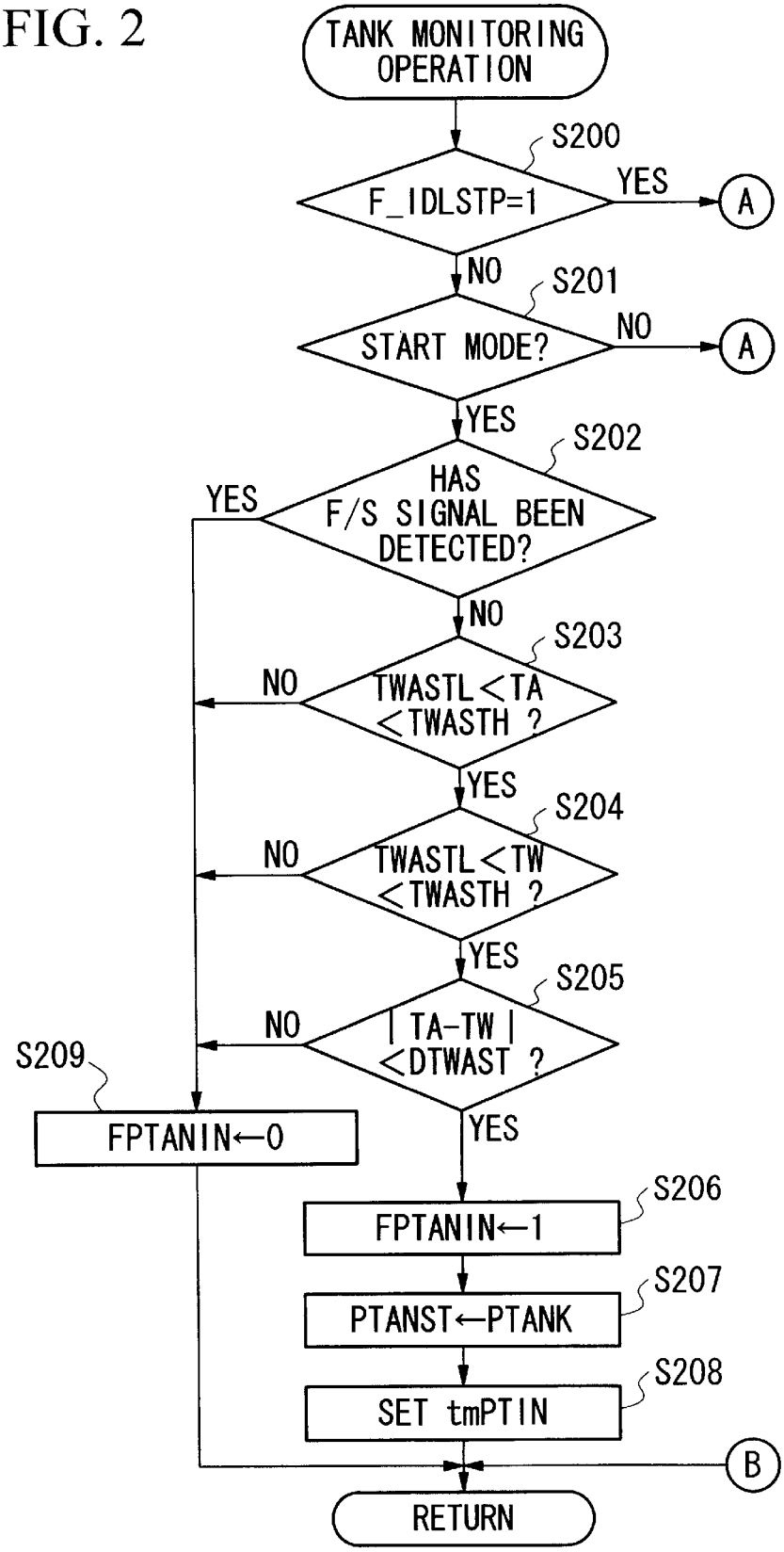
FIG. 2 is a flowchart showing the tank monitoring operation in the embodiment.
Figure 3:
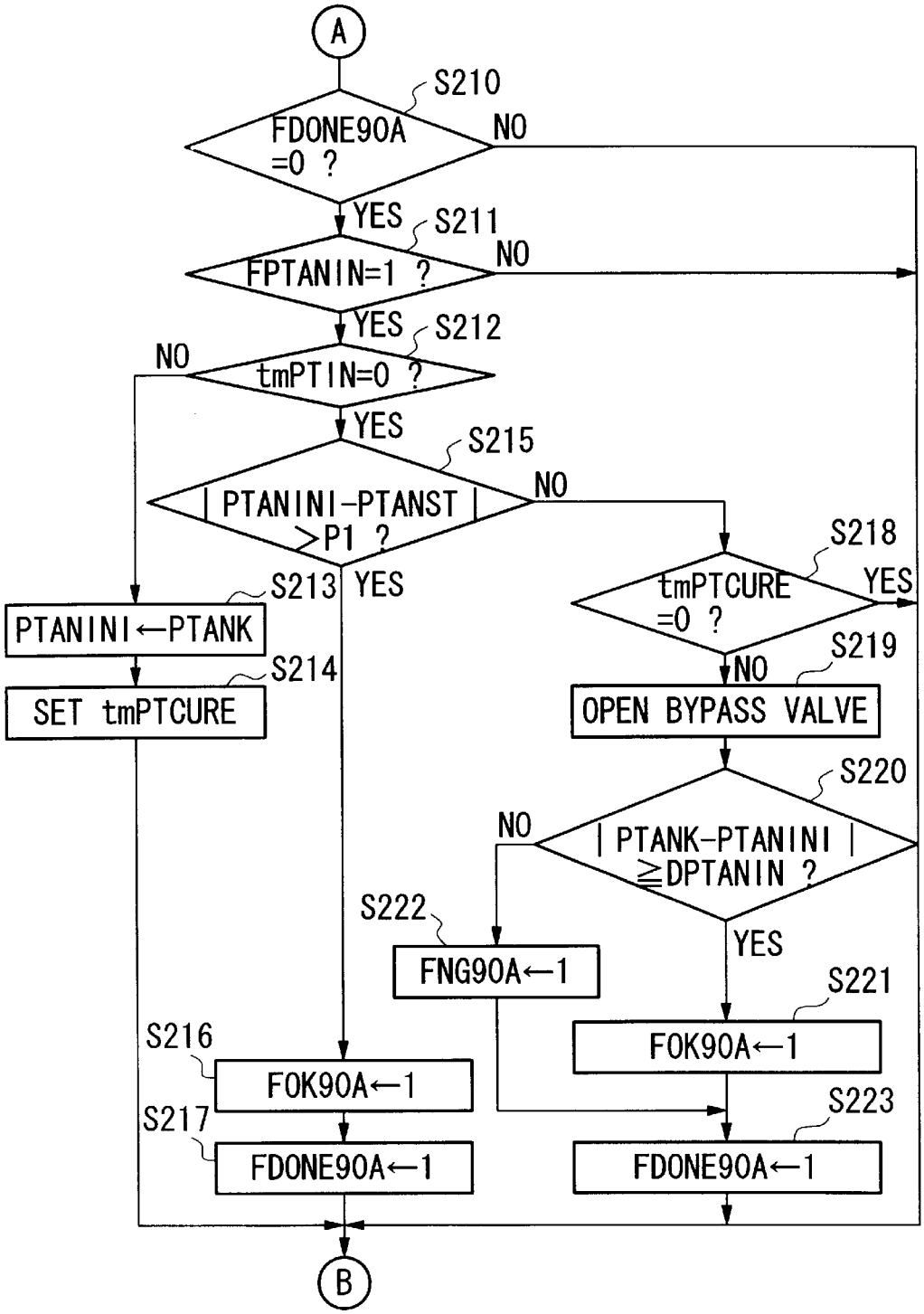
FIG. 3 is also a flowchart showing the tank monitoring operation in the embodiment.

First, the tank monitoring operation for monitoring the tank internal pressure will be explained. FIGS. 2 and 3 show a flowchart explaining the tank monitoring operation.

This tank monitoring operation is performed for determining whether leakage is present in the tank system when the cold internal combustion engine 11 is started, and this operation is executed at regular intervals of a predetermined time, for example, every 80 msec.

In the first step S200 in FIG. 2, it is determined whether the value of an idle stop flag F_IDLSTP is 1. Here, the "idle stop" means an operation for stopping the fuel supply to the internal combustion engine 11 by ECU 13 so as to stop the internal combustion engine 11, and for prohibiting unnecessary idle driving operation, so as to decrease fuel consumption.

The idle stop flag F_IDLSTP is set to 1 when, for example, (i) the vehicle speed V reaches a predetermined speed (which may be 0) during the deceleration or the like, and after that the shift position is in a neutral or P (parking) position, or (ii) the brake pedal is depressed though the shift position is in a D (forward) or R (reverse) position. Here, it is determined whether the internal combustion engine 11 can be restarted by activating the starter motor even if the internal combustion engine 11 is stopped. According to the determination, if the electric power is insufficient, then the internal combustion engine 11 is not stopped and the idle driving operation is maintained.

In addition, the internal combustion engine 11 is restarted from the idle stop state when, for example, the clutch switch is switched on and the shift position is in the in-gear state. In such a case, the starter motor is automatically driven by ECU 13, so that the internal combustion engine 11 is started.

If the result of the determination in step S200 is "YES", that is, if it is determined that the internal combustion engine 11 is in the idle stop state or is being restarted after the idle stop, then the processes from step S210 (explained later) are executed.

On the other hand, if the result of the determination in step S200 is "NO", that is, if the ignition switch is on and the internal combustion engine 11 is initially started, or if the vehicle is being driven (i.e., during driving), then the operation proceeds to step S201.

In step S201, it is determined whether the internal combustion engine 11 is in a start mode. If the rotation speed NE of the internal combustion engine 11 is equal to or below a predetermined starting rotation speed (e.g., 400 rpm), it is determined that the internal combustion engine 11 is in the start mode. Here, the rotation speed NE is calculated based on an elapsed time from the generation of a previous signal for determining the TDC to the generation of the present signal for determining the TDC.

If the result of the determination is "NO", that is, if the internal combustion engine 11 is not in the start mode, then the processes from step S210 (explained later) are executed.

If the result of the determination is "YES", that is, if the internal combustion engine 11 is in the start mode, then the operation proceeds to step S202, where it is determined whether a fail-safe (F/S) signal indicating that the internal combustion engine 11 has no failure has already been detected.

If the result of the determination is "YES", that is, if the F/S signal has already been detected, then the value of a tank monitoring operation permitting flag FPTANIN is set to 0 (see step S209), and the operation of this flow is completed. Here the flag FPTANIN is provided for determining whether an operation for determining leakage of the fuel tank 51 can be executed. That is, in the step S209, the tank monitoring operation permitting flag FPTANIN is initialized.

If the result of the determination in step S202 is "NO", that is, if the F/S signal has not yet been detected, then it is determined whether the intake air temperature TA is within a range from a predetermined lower value TWASTL to a predetermined upper value TWASTH (see step S203).

If the result of the determination is "NO", the processes from step S209 are executed, while if the result of the determination is "YES", that is, if the intake air temperature TA is within the predetermined range, then it is determined whether the water temperature TW is within a range from a predetermined lower value TWASTL to a predetermined upper value TWASTH (see step S204).

If the result of the determination is "NO", the processes from step S209 are executed, while if the result of the determination is "YES", that is, if the intake air temperature TW is within the predetermined range, then it is determined whether the absolute value of the difference between the intake air temperature TA and the water temperature TW is smaller than a reference value DTWAST (see step S205).

If the result of the determination is "NO", the processes from step S209 are executed, while if the result of the determination is "YES", that is, if both of the intake air temperature TA and the water temperature TW are within the predetermined range from the lower value TWASTL to the upper value TWASTH, and if absolute value of the difference between the intake air temperature TA and the water temperature TW is smaller than the reference value DTWAST (i.e., only when the cold internal combustion engine is initially started), the operation proceeds to step S206.

In the step S206, the tank monitoring operation permitting flag FPTANIN is set to 1, and the current tank internal pressure PTANK is determined as an initial pressure PTANST in the fuel tank 51 when the internal combustion engine 11 is started (see step S207). In the following step S208, a timer tmPTIN for monitoring the tank internal pressure is set to a predetermined time TPTIN, and the operation is completed.

In step S210 in FIG. 3, it is determined whether a tank monitor completion flag FDONE90A is 0. Here, the tank monitor completion flag FDONE90A having a value of 1 indicates that the tank monitoring operation has been completed. According to the determination, if the value of the tank monitor completion flag FDONE90A is 1, then the operation of this flow is completed.

On the other hand, if the value of the tank monitor completion flag FDONE90A is 0, then the operation proceeds to step S211.

In the step S211, it is determined whether the value of the tank monitoring operation permitting flag FPTANIN is 1. According to the determination, if the value of the tank monitoring operation permitting flag FPTANIN is 0, the operation of this flow is completed, while if the value is 1, then the operation proceeds to step S212.

In the step S212, it is determined whether the value of an internal pressure monitoring timer tmPTIN, which is a subtraction timer, has reached 0.

According to the determination, if the value of the internal pressure monitoring timer tmPTIN, which is gradually decreased, has not yet reached 0, then the current internal pressure PTANK of the fuel tank is determined as the pressure in the fuel tank 51 before the bypass valve 55 is opened, that is, a pre-open pressure PTANINI is set to the current internal pressure PTANK (see step S213). In the following step S214, a bypass valve opening control timer tmPTCURE is set to a predetermined time TPCURE, and the operation of this flow is then completed.

Here, the predetermined time TPCURE is, for example, a necessary time from the opening of bypass valve 55 to the time when the tank internal pressure PTANK reaches the atmospheric pressure.

If the result of the determination in step S212 is "YES", that is, if the value of the internal pressure monitoring timer tmPTIN has already reached 0, then the operation proceeds to step S215, where it is determined whether the absolute value AB1 between the pre-open pressure PTANINI and the initial pressure PTANST is larger than a reference value P1.

If the result of the determination is "YES", that is, if the absolute value AB1 is larger than the reference value P1, then the value of a tank system normal state determination flag FOK90A is set to 1 (see step S216). The flag FOK90A having a value of 1 indicates that the tank system has no leakage and normally operates. In the following step S217, the tank monitor completion flag FDONE90A is set to 1, and the present operation is completed.

Accordingly, the normal state of the tank system can be detected at the early phase; thus, it is unnecessary to perform the processes (from step S218, explained later) for determining presence or absence of an abnormal state of the tank system according to the opening of the bypass valve 55.

On the other hand, if the result of the determination in step S215 is "NO", that is, if the absolute value AB1 is equal to or below the reference value P1, the operation proceeds to step S218, where the value of the bypass valve opening control timer tmPTCURE, which has been gradually decreased, has reached 0.

If the result of the determination is "YES", the operation of this flow is completed, while if the result of the determination is "NO", then the operation proceeds to step S219.

In the step S219, the bypass valve 55 is opened, and then the operation proceeds to step S220, where it is determined whether the absolute value AB2 between the current tank internal pressure PTANK and the pre-open pressure PTANINI is equal to or above a reference value DPTANIN (e.g., 266.6 Pa).

According to the determination, if the absolute value AB2 is equal to or above the reference value DPTANIN, the value of the tank system normal state determination flag FOK90A is set to 1 (see step S221), and the value of the tank monitor completion flag FDONE90A is set to 1 (see step S223). The present operation is then completed.

On the other hand, if the result of the determination in step S220 indicates that the absolute value AB2 is below the reference value DPTANIN, the value of flag FNG90A is set to 1 (see step S222). Here, the flag FNG90A having a value of 1 indicates that the tank system has leakage and thus is in an abnormal state. The operation then proceeds to the step S223.

The evaporating fuel processing apparatus 10 of an internal combustion engine of the present embodiment effectively uses a phenomenon in the tank monitoring operation that the pressure in the fuel tank 51 equalizes to the atmospheric pressure if the bypass valve 55 is opened when the cold internal combustion engine 11 is initially started. That is, the presence or absence of leakage in the tank system is determined based on the variation of the detected value of the internal pressure sensor 56. If the variation of the tank internal pressure PTANK in the predetermined elapsed time TPTCURE is equal to or above the predetermined reference value DPTANIN, then it is possible to determine that the tank system has no leakage and thus is in a normal state.

Here, even if the operation mode of the vehicle is shifted to the idle stop mode and thus the internal combustion engine 11 is stopped and then is restarted, the initial processes from step S202 to step S209 are not executed. For example, it is possible to prevent the initial pressure PTANST, the timer tmPTIN for monitoring the tank internal pressure, or the like, from being reset. In addition, the diagnosis processes from step S210 can be continued.

Figure 4:
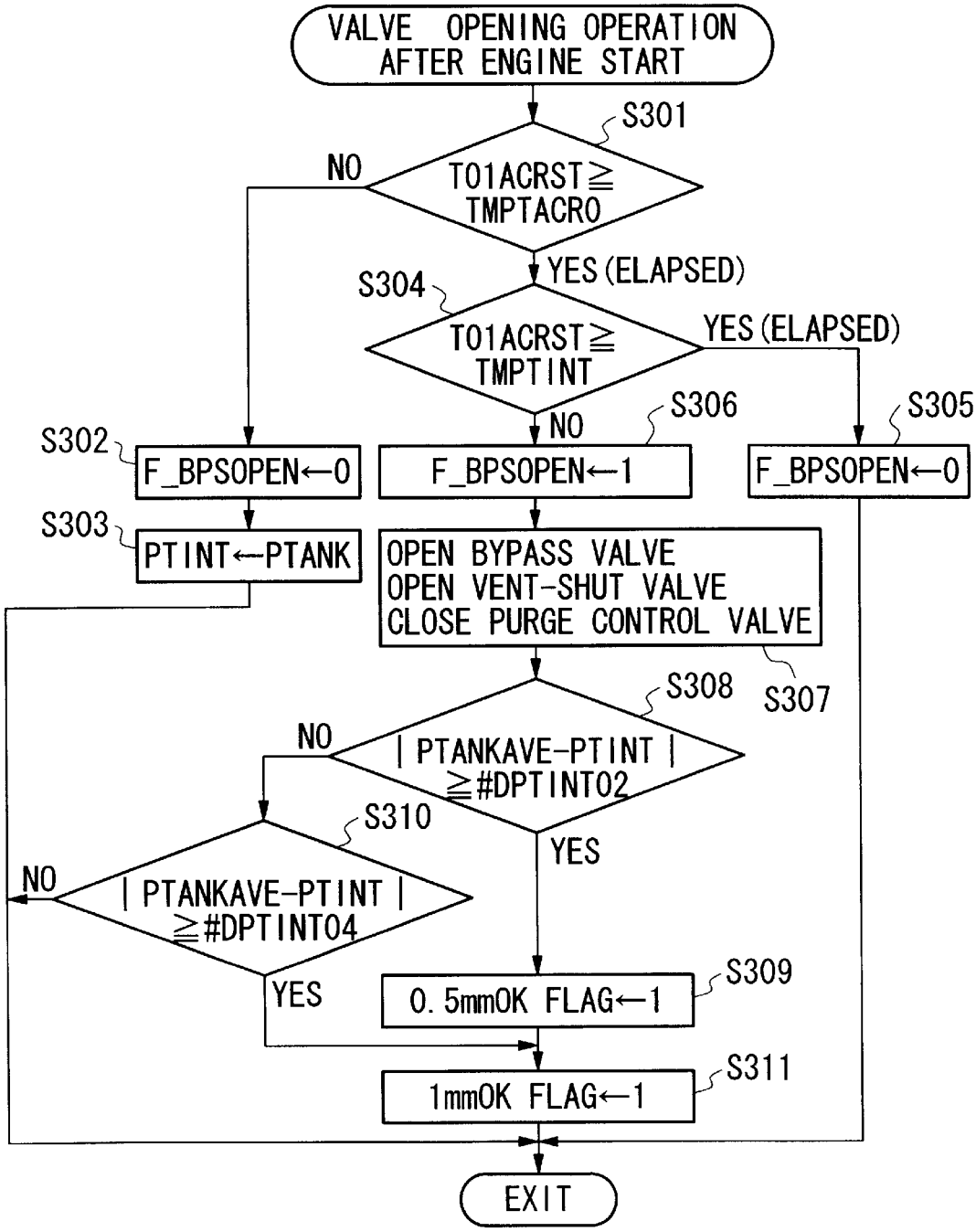
FIG. 4 is a flowchart showing the valve opening operation after the engine start in the embodiment.
Figure 5:
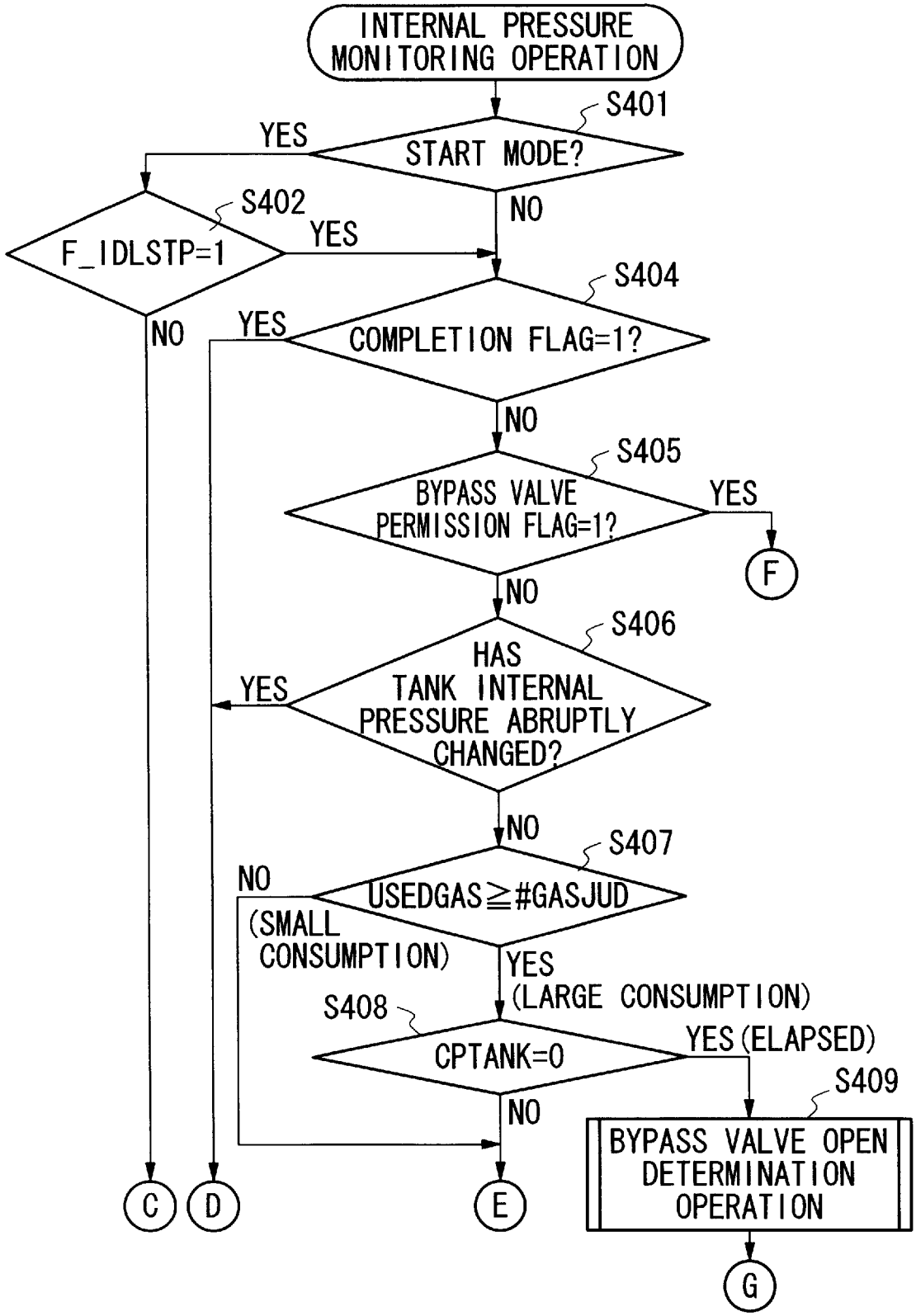
FIG. 5 is a flowchart showing the internal pressure monitoring operation in the embodiment.
Figure 6:
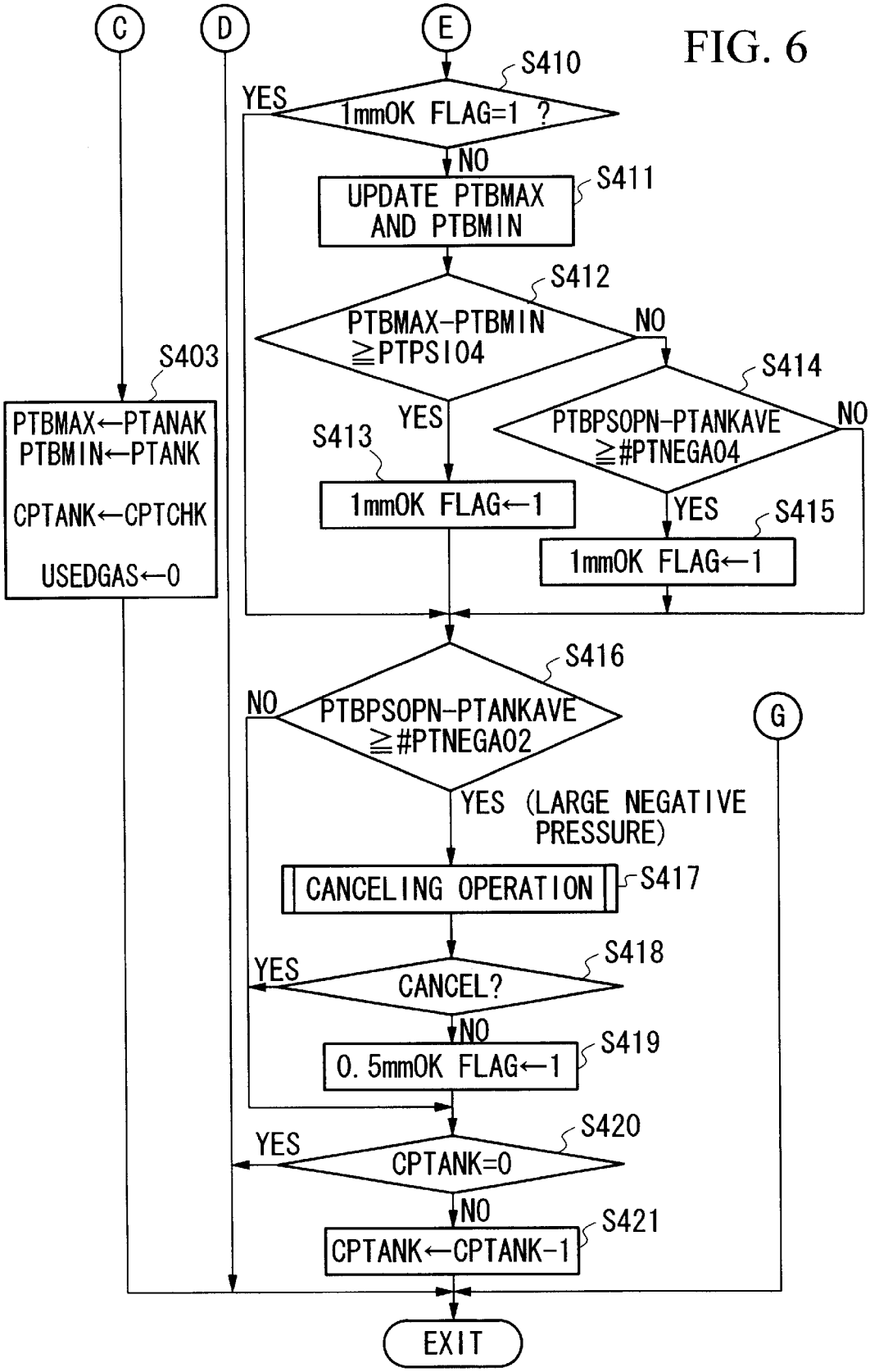
FIG. 6 is also a flowchart showing the internal pressure monitoring operation in the embodiment.
Figure 7:
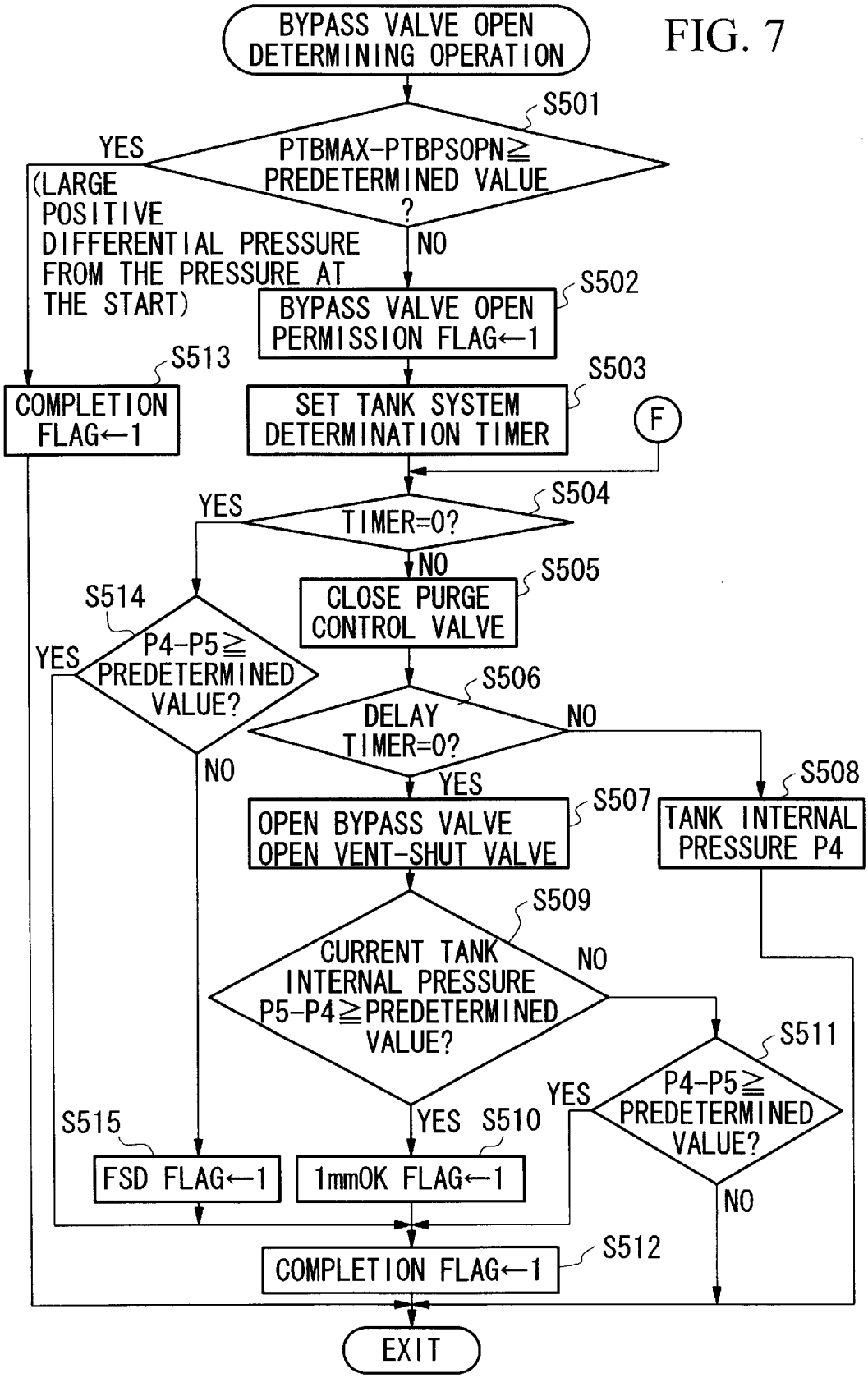
FIG. 7 is a flowchart showing the bypass valve open determining operation shown in FIG. 5 in the embodiment.

Below, a variation of the operation of the evaporating fuel processing apparatus 10 of the internal combustion engine according to the present embodiment will be explained with reference to the drawings. This variation is provided for determining the presence or absence of leakage of the discharge suppression system 12, and has a valve opening operation after the start of the internal combustion engine, and an internal pressure monitoring operation. FIG. 4 is a flowchart showing the valve opening operation after the start of the internal combustion engine, and FIGS. 5 and 6 show a flowchart showing the internal pressure monitoring operation. FIG. 7 is a flowchart showing a bypass valve open determination operation in FIG. 5, and FIG. 8 shows a canceling operation in FIG. 6.

Valve opening operation after the start of internal combustion engine

In this operation, the bypass valve 55 is opened immediately after the internal combustion engine 11 is started, so that the discharge suppression system 12 is released towards the atmospheric pressure. In this process, if the variation of the tank internal pressure PTANK from its value before the release towards the air is equal to or above a predetermined value, it is determined that the tank system has no leakage and thus is in a normal state.

In the first step S301 in FIG. 4, it is determined that the value of a timer T01 ACRST is equal to or above a timer value TMPTACR0 (e.g., 1 sec) provided, where after the start of the internal combustion engine, the state of the PTANK sensor has stabilized after the time indicated by the timer value TMPTACR0 has elapsed. Here, the timer T01ACRST is started when the ignition switch is switched on, that is, at the initial start of the internal combustion engine 11, and this timer does not stop even if the vehicle is in the idle-stop state.

If the result of the determination is "NO", that is, if the internal pressure sensor 56 is still in an unstable state, the operation proceeds to step S302, where the value of a bypass valve open flag F_BPSOPEN is set to 0. In the following step S303, the tank internal pressure PTINT of the cold tank at the initial start is set to the current tank internal pressure PTANK, and the operation of this flow is completed.

On the other hand, if the result of the determination in step S301 is "YES", that is, if the time necessary for obtaining a stable state of the internal pressure sensor 56 has elapsed, the operation proceeds to step S304.

As explained above, the timer T01ACRST does not stop from the initial start of the internal combustion engine 11;

thus, the tank internal pressure PTINT is not updated after the time indicated by the above value TMPTACR0 (e.g., 1 sec) has elapsed.

In step S304, it is determined whether the value of the timer T01ACRST is equal to or above a timer value TMPTINT (e.g., 20 sec). This timer value is provided for determining whether the tank system is in a normal state when the cold internal combustion engine is started. If the result of the determination is "YES", the value of the bypass valve opening flag F_BPSOPEN is set to 0 (see step S305), and the operation of the present flow is completed.

On the other hand, if the result of the determination in step S304 is "NO", the bypass valve opening flag F_BPSOPEN is set to 1 (see step S306), and in the following step S307, the bypass valve 55 is opened, the vent-shut valve 58 is opened, and purge control valve 59 is closed (see step S307).

That is, in the time indicated by the predetermined timer value TMPTINT, the discharge suppression system 12 is released towards the atmospheric pressure.

In the next step S308, it is determined whether the absolute value of the deviation of the tank internal pressure PTINT (determined when the cold engine is started) from an average PTANKAVE of the tank internal pressure (i.e., the average of the tank internal pressure PTANK) is equal to or above a first predetermined determination value #DPTINT02 (e.g., 533.3 Pa). This first predetermined determination value #DPTINT02 is provided for determining the presence or absence of leakage caused by a first kind of a minute hole, for example, a hole having a diameter of approximately 0.5 mm.

In addition, the absolute value of the deviation is used for comparison; thus, determination suitable for the current driving state of the vehicle can be performed in either case that the tank internal pressure PTINT has a positive or negative pressure.

If the result of the determination is "YES", then it is determined that there is no leakage caused by a hole having a diameter of 0.5 mm or more, and the value of the "0.5 mmOK" flag is set to 1 (see step S309), and the operation proceeds to step S311 explained later.

On the other hand, if the result of the determination in step S308 is "NO", that is, if it is determined that leakage caused by a hole having a diameter of approximately 0.5 mm has occurred, then the operation proceeds to step S310.

In the step S310, it is determined whether the absolute value of the deviation of the tank internal pressure PTINT (determined when the cold engine is started) from the average PTANKAVE of the tank internal pressure is equal to or above a second predetermined determination value #DPTINT04 (e.g., 266.6 Pa). This second predetermined determination value #DPTINT04 is provided for determining the presence or absence of leakage by a second kind of hole larger than the first kind of hole, for example, a hole having a diameter of approximately 1 mm.

If the result of the determination is "NO", that is, if it is determined that there is leakage caused by a hole having a diameter of approximately 1 mm, the operation of the present flow is completed.

On the other hand, if the result of the determination in step S310 is "YES", that is, if it is determined that there is no leakage caused by a hole having a diameter of approximately 1 mm, then the value of a "1 mmOK" flag is set to 1 (see step S311), and the present operation is completed.

In this case, the value of the "0.5 mmOK" flag is 0 and the value of the "1 mmOK" flag is 1, and in the internal pressure monitoring operation explained later, the presence or absence of leakage is determined with reference to the first kind of hole.

In addition, the current average PTANKAVE of the tank internal pressure is used in the internal pressure monitoring operation; thus, this average PTANKAVE is stored as a tank internal pressure PTBPSOPN (in the air-open mode) in RAM 43.

Internal pressure monitoring operation

Below, the internal pressure monitoring operation will be explained.

In this operation, the output level of the internal pressure sensor 56 is continuously checked, and if the level is almost fixed at the atmospheric pressure, it is determined that there is leakage, while if the variation of the level is large towards the positive or negative side, it is determined that there is no leakage.

In the first step S401 in FIG. 5, it is determined whether the preset operation mode is a start mode. If the result of the determination is "NO", the operation proceeds to step S404 which is explained later.

On the other hand, if the result of the determination is "YES", the operation proceeds to step S402, where it is determined whether the value of an idle stop flag F_IDLSTP is 1.

If the result of the determination is "YES", that is, if it is determined that the internal combustion engine 11 is in the idle stop state or is being restarted after the idle stop operation, then the processes from step S404 (explained later) are executed.

If the result of the determination in step S402 is "NO", that is, if it is determined that the internal combustion engine 11 is being initially started (when the ignition switch is switched on) or the vehicle is being driven, then the operation proceeds to step S403.

In the step S403 for initializing some parameters in FIG. 6, (i) both of the tank internal pressure maximum value PTBMAX and tank internal pressure minimum value PTBMIN are set to the current tank internal pressure PTANK, (ii) a subtraction counter CPTANK is set to a predetermined counter value CPTCHK, and (iii) an amount of fuel consumption USEDGAS is set to 0. The operation of this flow is then completed.

Here, the above counter value CPTCHK is selected and predetermined by searching a data table, according to water temperature TW obtained when the internal combustion engine 11 is initially started.

In step S404 in FIG. 5, it is determined whether the value of a completion flag is 1. As explained later, the value of this completion flag is set to 1 when the bypass valve open determining operation is completed. When the result of the determination in step S404 is "YES", the operation of this flow is completed. On the other hand, if the result of the determination is "NO", the operation proceeds to step S405.

In the step S405, it is determined whether the value of a bypass valve permission flag is 1. If the result of the determination is "YES", the processes from step S504 (explained later) are executed, while if the result of the determination is "NO", the operation proceeds to step S406.

In the step S406, it is determined whether the absolute value of a difference between the current tank internal pressure PTANK and the tank internal pressure PTBASE, which was previously detected and has been stored in RAM 43, that is, |PTANK-PTBASE| is equal to or above a predetermined value. According to the determination, it is determined whether the tank internal pressure PTANK has experienced an abrupt change. Such an abrupt change of the tank internal pressure PTANK occurs when, for example, the liquid (level) of the fuel contained in the fuel tank 51 is shaken due to sudden start of the vehicle or the like, and the contact area of fuel onto the wall surface of the tank is increased, so that the fuel is abruptly vaporized.

If the result of the determination is "YES", it is determined that the present state is not suitable for detection of leakage of the evaporating fuel; thus, the present operation of this flow is completed. On the other hand, if the result of the determination is "NO", then the operation proceeds to step S407.

In the step S407, it is determined whether the amount of fuel consumption USEDGAS is equal to or above a predetermined determination value #GASJUD.

If the result of the determination is "NO", that is, if it is determined that the fuel consumption is small, the processes from step S410 (explained later) are executed.

On the other hand, if the result of the determination is "YES", that is, if it is determined that the fuel consumption is large, then the operation proceeds to step S408, where it is determined whether the count value of subtraction counter CPTANK is 0.

Here, the calculation of the amount of fuel consumption USEDGAS is independently performed apart from the internal pressure monitoring operation, for example, the calculation of USEDGAS is executed in the background. The CPU 41 multiplies the integrated value of the open time of the fuel injection valve 24 for a predetermined period by a predetermined coefficient, and the product is converted to the amount of fuel consumption USEDGAS for the predetermined period and the amount USEDGAS is stored in RAM 43. Accordingly, the amount of fuel consumption USEDGAS is updated at regular intervals of the predetermined period.

If the result of the determination in step S408 is "YES", that is, after a predetermined time has elapsed, the bypass valve open determination operation in step 409 is executed. Here, the result of the determination is "YES" when, for example, the value of the "1 mmOK" flag is not set to 1 even if the processes from step S410 are executed several times, and thus the condition relating to the second kind of hole is not satisfied.

On the other hand, if the result of the determination in step S408 is "NO", the operation proceeds to step S410.

In the step S410 in FIG. 6, it is determined whether the value of the "1 mmOK" flag is 1. If the result of the determination is "YES", the processes from step S416 (explained later) are executed. On the other hand, if the result of the determination is "NO", then the operation proceeds to step S411, where the tank internal pressure maximum value PTBMAX and the tank internal pressure minimum value PTBMIN are updated.

That is, if the tank internal pressure average PTANKAVE of a plurality of tank internal pressure values PTANK (measured by internal pressure sensor 56) is larger than the tank internal pressure maximum value PTBMAX stored in RAM 43, then the tank internal pressure maximum value PTBMAX is set and updated to the tank internal pressure average PTANKAVE, so that the relevant data is updated.

On the other hand, if the tank internal pressure average PTANKAVE of a plurality of tank internal pressure values PTANK is smaller than the tank internal pressure minimum value PTBMIN stored in RAM 43, then the tank internal pressure minimum value PTBMIN is set and updated to the tank internal pressure average PTANKAVE, so that the relevant data is updated.

In the next step S412, it is determined whether the operation result of subtracting the tank internal pressure minimum value PTBMIN from the tank internal pressure maximum value PTBMAX, that is, the variation width of the tank internal pressure PTANK is equal to or above a first predetermined reference value PTPSI04. This reference value PTPSI04 is selected by searching a map or the like, stored in ROM 42, with reference to the water temperature TW at the starting time of the internal combustion engine 11. Here, the water temperature TW serves as a parameter for the search.

If the result of the determination is "YES", the operation proceeds to step S413, where the value of the "1 mmOK" flag is set to 1, and the processes from step S416 (explained later) are executed.

On the other hand, if the result of the determination in the step S412 is "NO", the operation proceeds to step S414. In the step S414, it is determined whether the operation result of subtracting the tank internal pressure average PTANKAVE from the tank internal pressure PTBPSOPN of the air-open mode (PTBPSOPN is set in the above-explained valve opening operation after the engine start) is equal to or above a determination value #PTNEGA04 (e.g., 266.6 Pa) for detecting presence or absence of leakage caused by the second kind of hole having a diameter of, for example, 1 mm or more.

If the result of the determination is "NO", the operation proceeds to step S416, which is explained later, while if the result of the determination is "YES", that is, if it is determined that the tank system can maintain the negative pressure and no leakage with respect to a reference hole having a diameter of approximately 1 mm, then the operation proceeds to step S415. In the step S415, the value of the "1 mmOK" flag is set to 1, and the operation proceeds to step S416.

In the step S416, it is determined whether the result of the operation of subtracting the tank internal pressure average PTANKAVE from the above tank internal pressure PTBPSOPN of the air-open mode is equal to or above a determination value #PTNEGA02 (e.g., 666.5 Pa) for detecting presence or absence of leakage caused by the first kind of hole having a diameter of, for example, 0.5 mm or more.

If the result of the determination is "NO", the processes from step S420 (explained later) are executed.

If the result of the determination is "YES", then it is possible to determine that the tank system can maintain a large negative pressure, and thus has no leakage caused by a hole having a diameter of 0.5 mm or more. Accordingly, the canceling operation in step S417 (explained later) is executed.

As explained later, in the canceling operation in step S417, it is determined whether there is another factor for providing a negative pressure of the tank system regardless of the presence or absence of leakage.

In the following step S418, it is determined whether it is necessary to cancel the determination result of step S416. If the result of the determination is "YES", the processes from step S420 (explained later) are executed. On the other hand, if the result of the determination is "NO", the value of the "0.5 mmOK" flag is set to 1, and the operation proceeds to step S420.

In the step S420, it is determined whether the counter value of the subtraction counter CPTANK is 0. If the result of the determination is "YES", the operation of this flow is completed. On the other hand, if the result of the determination is "NO", then the operation proceeds to step S421, where the subtraction counter CPTANK is set to a value obtained by subtracting 1 from the current counter value thereof, and the operation of the present flow is completed.

The internal pressure monitoring operation is repeated at regular intervals of a predetermined period (e.g., 80 ms) until the count value of the subtraction counter CPTANK becomes 0. When the count becomes 0, the bypass valve open determining operation shown in FIG. 7 is executed. In this bypass valve open determining operation, the value of the completion flag used in the internal pressure monitoring operation is set to 1 in step S512 or S513 explained later, so that the internal pressure monitoring operation is completed via the process of the above-explained step S404.

Accordingly, in a single cycle from start to stop of the internal combustion engine 11, after the internal pressure monitoring operation is completed, this operation is never repeated again. However, the frequency in execution of this monitoring operation can be suitably determined and modified when the system is designed.

Bypass valve open determining operation

The bypass valve open determining operation will be explained with reference to FIG. 7.

In the first step S501 in FIG. 7, it is determined whether the operation result obtained by subtracting the tank internal pressure PTBPSOPN (of the air-open mode) from the tank internal pressure maximum value PTBMAX is equal to or above a predetermined value which is read out from ROM 42 according to the water temperature TW. More specifically, ROM 42 of ECU 13 stores a table (or the like) including values corresponding to each water temperature TW (functioning as a parameter) which is detected when the internal combustion engine 11 is started, and one of the values stored in the table is read out according to the relevant water temperature TW.

If the result of the determination in step S501 is "NO", the value of a bypass valve open permission flag, provided for opening the bypass valve 55, is set to 1 (see step S502), and a tank system determination timer for determining the state of the tank system is set to a time necessary for the bypass valve open determining operation (see step S503).

In the next step S504, it is determined whether the value of the above timer is 0. If the result of the determination is "NO", the operation proceeds to step S505, where the purge control valve 59 is closed. The operation then proceeds to step S506. On the other hand, if the result of the determination is "YES", the process of step S514 (explained later) is executed.

The process of step S506 is provided for awaiting a stable state of the opening of the purge control valve 59, and it is determined whether the timer value of a delay timer is 0. If the result of the determination is "NO", the operation proceeds to step S508, where the current average P4 of the tank internal pressure PTANK is stored in RAM 43, and the operation of this flow is completed. On the other hand, if the result of the determination is "YES", the operation proceeds to step S507.

This bypass valve open determining operation is executed at regular intervals of a predetermined period, for example, 80 ms. After the operation of this flow is completed via step S508, when the bypass valve open determining operation is restarted, the timer value of the delay timer is checked. If the timer value has reached 0, then ECU 13 sends a control signal and the bypass valve 55 and vent-shut valve 58 are opened, so that the tank system is released towards the atmospheric pressure (see step S507).

In the next step S509, it is determined whether the current tank internal pressure P5 has increased from the tank internal pressure P4 (before the release) by a first predetermined value or more.

If the result of the determination is "YES", that is, if the tank system can maintain a negative pressure, then it is determined that no leakage caused by a hole having a diameter of 1 mm or more, and the value of the "1 mmOK" flag is set to 1 (see step S510), and the completion flag for completing the internal pressure monitoring operation is set to 1 (see step S512), and the operation of the present flow is completed.

On the other hand, if the result of the determination in step S509 is "NO", that is, if the variation from a negative pressure to a positive pressure is smaller than a predetermined value, the operation proceeds to step S511. In the step S511, it is determined whether a value obtained by subtracting the tank internal pressure P5 from the tank internal pressure P4 is equal to or above a predetermined value, that is, whether the tank internal pressure P5 (after the release of the tank internal pressure towards the atmospheric pressure) has decreased from the tank internal pressure P4 (before the release) by a second predetermined value, in other words, whether a large variation from a positive pressure towards the atmospheric pressure has occurred.

Here, the second predetermined value may differ from the first predetermined value used in the above step S509. For example, the second predetermined value can be obtained by searching a table stored in ROM 42 of ECU 13, which has values with respect to each water temperature TW (detected when the internal combustion engine 11 is started) as a parameter.

If the result of the determination in step S511 is "YES", the operation proceeds to step S512, and the operation of this flow is completed. That is, if the variation of the pressure of the tank system is large, it is possible to determine that the tank system has an ability of maintaining the necessary pressure. However, the variation from a positive pressure is not suitable for detecting the presence or absence of leakage caused by a minute hole; thus, the value of the "1 mmOK" flag is not set to 1, while the value of the completion flag is set to 1 (see step S512). The operation of the present flow is then completed.

On the other hand, if the result of the determination in step S511 is "NO", that is, if it is determined that the variation of the pressure is not large, then the value of the completion flag is not set to 1 so as to execute the bypass valve open determining operation again. The present operation is then completed.

If the result of the determination in step S504 is "YES", that is, if the bypass valve open determining operation has been repeatedly executed and the timer value of the tank system determination timer has become 0, the operation proceeds to step S514. Similar to the step S511, in step S514, it is determined whether a value obtained by subtracting the tank internal pressure P5 from the tank internal pressure P4 is equal to or above a predetermined value, that is, whether the tank internal pressure P5 (after the release of the tank internal pressure towards the atmospheric pressure) has decreased from the tank internal pressure P4 (before the release) by a second predetermined value, in other words, whether a large variation from a positive pressure towards the atmospheric pressure has occurred.

If the result of the determination is "YES", that is, if the variation from a positive pressure towards the atmospheric pressure is large, the value of the completion flag is set to 1 (see step S512), and then the operation of this flow is completed.

On the other hand, if the result of the determination is "NO", that is, if the variation of the pressure is not large, the value of an FSD flag is set to 1 (see step S515), and then the value of the completion flag is set to 1 (see step S512). The operation of this flow is then completed. Here, the FSD flag is used for the system fault diagnosis.

On the other hand, if the result of the determination in step S501 is "YES", that is, if it is determined that the positive differential pressure from the pressure at the start of the internal combustion engine is large, then the operation proceeds to step S513. In the step S513, the value of the completion flag is set to 1, and the operation of this flow is completed.

Canceling operation

Below, the canceling operation will be explained with reference to FIG. 8. If, in the above internal pressure monitoring operation, it is determined that there is no leakage with respect to a reference hole having a diameter of approximately 0.5 mm and the value of the "0.5 mmOK" flag is set to 1, then in the canceling operation, it is determined whether there is another factor making the pressure of the tank system negative, regardless of the leakage of the tank system. If it is determined that there is such a factor, then the determination result for setting the value of the "0.5 mmOK" flag to 1 is canceled, and the internal pressure monitoring operation is continued.

Examples of a factor for making the pressure of the tank system negative are a driving state of the vehicle with a high load, a large increase of the atmospheric pressure when the vehicle is driving from a higher to a lower land, and the like.

If the vehicle is driving with a high load, typically, when the vehicle is highly accelerated, the fuel is rapidly consumed and the internal pressure sensor 56 temporarily detects a negative pressure. Accordingly, even if there is leakage caused by a minute hole having a diameter of approximately 0.5 mm, the value of the "0.5 mmOK flag" may be set to 1.

On the other hand, if the vehicle is driven from an upland to a plain and thus the atmospheric pressure increases, then the internal pressure sensor 56 for detecting a differential pressure between the atmospheric pressure and the pressure of the tank system detects a variation of the pressure towards the negative direction. Also in this case, even if there is leakage caused by a minute hole having a diameter of approximately 0.5 mm, the value of the "0.5 mmOK" flag may be set to 1.

First, in step S601 in FIG. 8, it is determined whether the value obtained by subtracting the atmospheric pressure at the start of the internal combustion engine 11 (which is stored in advance in RAM 43) from the current atmospheric pressure is equal to or above a predetermined value (e.g., 733.15 Pa).

If the result of the determination is "YES", it is determined that the present state is not suitable for determining the presence or absence of leakage based on a reference hole having a diameter of approximately 0.5 mm, and the timer value of a cancel timer is set to a predetermined time (e.g., 60 sec) (see step S608). In the next step S609, the value of an OK determination prohibiting flag is set to 1 (see step S609), so that the determination result for setting the value of the "0.5 mmOK" flag to 1 is canceled.

Here, the above predetermined value (e.g., 733.15 Pa) indicates a variation of the atmospheric pressure towards the higher side, and it decreases the internal pressure of the tank system by 439.89 Pa.

On the other hand, if the result of the determination in step S601 is "NO", the operation proceeds to step S602. In the step S602, it is determined whether the product obtained by multiplying the amount of fuel injection per a predetermined time (calculated by ECU 13, for example, in a background operation) by rotation speed NE of the internal combustion engine 11 is equal to or above a predetermined value, that is, whether the load of the internal combustion engine 11 is equal to or above the predetermined value. Here, the predetermined value of the load is determined based on experimental or simulation data or the like, and a value near the critical value, which has an effect on the determination of the presence or absence of leakage based on a hole having a diameter of approximately 0.5 mm, is selected.

If the result of the determination in step S602 is "YES", the operation proceeds to step S603.

In the step S603, it is determined whether the value of a high-load drive determination timer for determining a high-load driving state is 0. The timer value of this timer is set to a predetermined time (e.g., 4 sec) in step S604 explained later.

If the determination is "YES", that is, if the vehicle is driving with a high load for a predetermined time, the present state is not suitable for determining the presence or absence of leakage based on a reference hole having a diameter of approximately 0.5 mm. Therefore, the operation proceeds to step S609, and the determination result for setting the value of the "0.5 mmOK" flag to 1 is canceled.

On the other hand, if the result of the determination in step S603 is "NO", the operation of the present flow is completed.

If the result of the determination in the step S602 is "NO", that is, if the load of the internal combustion engine 11 is smaller than the predetermined value, then the operation proceeds to step S604, where the timer value of the timer for determining a high-load driving state is set to a predetermined time (e.g., 4 sec), and the operation proceeds to step S605.

In the step S605, it is determined whether the value of the OK determination prohibiting flag is 1. If the result of the determination is "NO", the operation of the present flow is completed, while the result of the determination is "YES", the operation proceeds to step S606, where it is determined whether the timer value of the cancel timer has reached 0.

If the result of the determination is "NO", the present operation is completed, while if the result of the determination is "YES", the operation proceeds to step S607, where the value of the OK determination prohibiting flag is set to 0, so that the state of prohibiting the OK determination is released. The operation is then completed. That is, the operation for canceling the determination result for setting the value of the "0.5 mmOK" flag to 1 is released after a predetermined time (e.g., 60 sec).

According to the internal pressure monitoring operation explained above, the presence or absence of leakage caused by a reference hole having a diameter of approximately 1 mm or 0.5 mm is detected. If both the values of the "1 mmOK" flag and "0.5 mmOK" flag are set to 1, then it is determined that the tank system has no leakage and normally operates, and then the operation for detecting the presence or absence of leakage is completed.

If both the values of the "1 mmOK" flag and "0.5 mmOK" flag are set to 0, or if the value of the "1 mmOK" flag is set to 1 and the value of the "0.5 mmOK" flag is set to 0, then the presence or absence of leakage is detected by an operation of monitoring a reduced pressure, in which the pressure of the tank system is sufficiently reduced and the ability of maintaining a negative pressure is monitored.

That is, after the internal combustion engine 11 is started, the driving mode of the vehicle is shifted to the idle-stop mode and the internal combustion engine 11 is temporarily stopped. According to the evaporating fuel processing apparatus 10 of the present embodiment, even if the internal combustion engine 11 is restarted, (i) the value of the pressure in the fuel tank 51 at the starting of the internal combustion engine 11, (ii) the timer values used in the operation of monitoring the pressure of fuel tank 51, the internal pressure monitoring operation, and the like, (iii) parameters such as the elapsed time from the start, the amount of fuel consumption, and the like, are not updated and initialized. In addition, even if the idle stop operation is frequently repeated, it is possible to reliably determine the presence or absence of leakage in the evaporating fuel processing apparatus 10.

Furthermore, the determination of presence or absence of leakage is executed when the internal pressure sensor 56 indicates a negative pressure and the vehicle is not driven with a high load; thus, it is possible to prevent the erroneous determination that the negative pressure state of the tank system based on the high-load state is erroneously determined as a non-leakage state of the tank system.

Additionally, the determination of presence or absence of leakage is executed when the internal pressure sensor 56 indicates a negative pressure and the variation of the atmospheric pressure is smaller than a predetermined value; thus, it is possible to prevent an erroneous determination in that the negative pressure state of the tank system based on the variation of the atmospheric pressure is erroneously determined as a non-leakage state of the tank system.

What is claimed is:

1. An evaporating fuel processing apparatus of an internal combustion engine, comprising:

a fuel tank;

an evaporating fuel discharge suppression system for processing evaporating fuel generated in the fuel tank;

a leakage detecting section for detecting leakage in the evaporating fuel processing apparatus by referring to one or more parameters;

a stop condition determining section for determining whether a predetermined condition for stopping the internal combustion engine is satisfied;

a stop section for stopping the internal combustion engine when the stop condition determining section determines that the predetermined condition is satisfied;

a restart section for restarting the internal combustion engine after the internal combustion engine is stopped by the stop section;

a storage section for storing the one or more parameters referred to by the leakage detecting section; and an initializing section for initializing the one or more parameters when an ignition switch for starting the internal combustion engine is switched on.

2. An evaporating fuel processing apparatus as claimed in claim 1, further comprising:

a pressure detecting section for detecting the internal pressure of the fuel tank as a parameter referred to by the leakage detecting section and stored by the storage section.

3. An evaporating fuel processing apparatus as claimed in claim 1, further comprising:

a timer for measuring the elapsed time from the starting time of the internal combustion engine as a parameter referred to by the leakage detecting section and stored by the storage section.

4. An evaporating fuel processing apparatus as claimed in claim 1, mounted in a vehicle, wherein:

the predetermined condition is that the speed of the vehicle is below a predetermined value, and the shift position of the vehicle is in a neutral or parking position.

5. An evaporating fuel processing method of an internal combustion engine, applied to an evaporating fuel processing apparatus comprising a fuel tank, and an evaporating fuel discharge suppression system for processing evaporating fuel generated in the fuel tank, the method comprising:

a leakage detecting step for detecting leakage in the evaporating fuel processing apparatus by referring to one or more parameters;

a stop condition determining step for determining whether a predetermined condition for stopping the internal combustion engine is satisfied;

an engine stopping step for stopping the internal combustion engine when it is determined in the stop condition determining step that the predetermined condition is satisfied;

a restarting step for restarting the internal combustion engine after the internal combustion engine is stopped in the engine stopping step;

a storage step for storing the one or more parameters referred to by the leakage detecting step in a storage device; and an initializing step for initializing the one or more parameters stored in the storage device when an ignition switch for starting the internal combustion engine is switched on.

6. An evaporating fuel processing method as claimed in claim 5, further comprising:

a pressure detecting step for detecting the internal pressure of the fuel tank as a parameter referred to in the leakage detecting step and stored in the storage step.

7. An evaporating fuel processing method as claimed in claim 5, further comprising:

a time measuring step for measuring the elapsed time from the starting time of the internal combustion engine as a parameter referred to in the leakage detecting step and stored in the storage step.

8. An evaporating fuel processing method as claimed in claim 5, wherein:

the evaporating fuel processing apparatus is mounted in a vehicle, and;

the predetermined condition is that the speed of the vehicle is below a predetermined value, and the shift position of the vehicle is in a neutral or parking position.

9. A computer readable storage medium storing a program for making a computer execute an evaporating fuel processing operation of an internal combustion engine, applied to an evaporating fuel processing apparatus which comprises a fuel tank, and an evaporating fuel discharge suppression system for processing evaporating fuel generated in the fuel tank, the operation comprising:

a leakage detecting step for detecting leakage in the evaporating fuel processing apparatus by referring to one or more parameters;

a stop condition determining step for determining whether a predetermined condition for stopping the internal combustion engine is satisfied;

an engine stopping step for stopping the internal combustion engine when it is determined in the stop condition determining step that the predetermined condition is satisfied;

a restarting step for restarting the internal combustion engine after the internal combustion engine is stopped in the engine stopping step;

a storage step for storing the one or more parameters referred to by the leakage detecting step in a storage device; and an initializing step for initializing the one or more parameters stored in the storage device when an ignition switch for starting the internal combustion engine is switched on.

10. A computer readable storage medium as claimed in claim 9, wherein the operation further comprises:

a pressure detecting step for detecting the internal pressure of the fuel tank as a parameter referred to in the leakage detecting step and stored in the storage step.

11. A computer readable storage medium as claimed in claim 9, wherein the operation further comprises:

a time measuring step for measuring the elapsed time from the starting time of the internal combustion engine as a parameter referred to in the leakage detecting step and stored in the storage step.

12. A computer readable storage medium as claimed in claim 9, wherein:

the evaporating fuel processing apparatus is mounted in a vehicle, and;

the predetermined condition is that the speed of the vehicle is below a predetermined value, and the shift position of the vehicle is in a neutral or parking position.

* * * * *